United States Patent [19]
Witmer
[11] 4,276,983
[45] Jul. 7, 1981

[54] SORTING APPARATUS

[75] Inventor: Theodore B. Witmer, Winona Lake, Ind.

[73] Assignee: Bickley Manufacturing Company, Narberth, Pa.

[21] Appl. No.: 953,800

[22] Filed: Oct. 23, 1978

[51] Int. Cl.³ ..... B07C 5/344
[52] U.S. Cl. ..... 209/587; 209/580; 209/644; 250/223 R
[58] Field of Search ..... 209/576, 577, 580, 581, 209/587, 644; 250/223 R, 563, 578

[56] References Cited

U.S. PATENT DOCUMENTS

| | | | |
|---|---|---|---|
| 1,921,863 | 8/1933 | Bickley | 209/581 |
| 2,730,234 | 1/1956 | Bickley | 209/581 |
| 2,929,500 | 3/1960 | Warner | 209/581 |
| 3,472,375 | 10/1969 | Mathews | 209/932 |
| 3,835,332 | 9/1974 | Bridges | 250/563 |
| 4,165,277 | 8/1979 | Frewin | 209/577 X |

*Primary Examiner*—Joseph J. Rolla
*Attorney, Agent, or Firm*—Michael W. York

[57] ABSTRACT

A sorting apparatus for sorting objects including equipment for causing the objects to travel in a predetermined direction or path. The sorting apparatus includes equipment for emitting light within a given frequency range located in such a position to illuminate at least a portion of the objects as the objects travel in the predetermined direction or path. The sorting apparatus also includes equipment for detecting at least a portion of the reflected light resulting from the illumination of at least a portion of each of the objects that are subjected to the emitted light. Equipment is also provided for sorting the objects based upon the detection of the reflected light from the objects that are subjected to the emitted light. The detection equipment is sufficient to insure that the light pulses are received at a sufficient time frequency or periodic intervals to insure that reflected light is detected from each object. The detection equipment also includes a provision for varying the capability of receiving various intensities of reflected light in a given frequency range. Furthermore, the sorting apparatus includes detecting equipment that need not be focused on the objects that are to be sorted. The sorting apparatus is particularly useful in detecting defects in such articles as beans and the like.

4 Claims, 5 Drawing Figures

Fig. 4
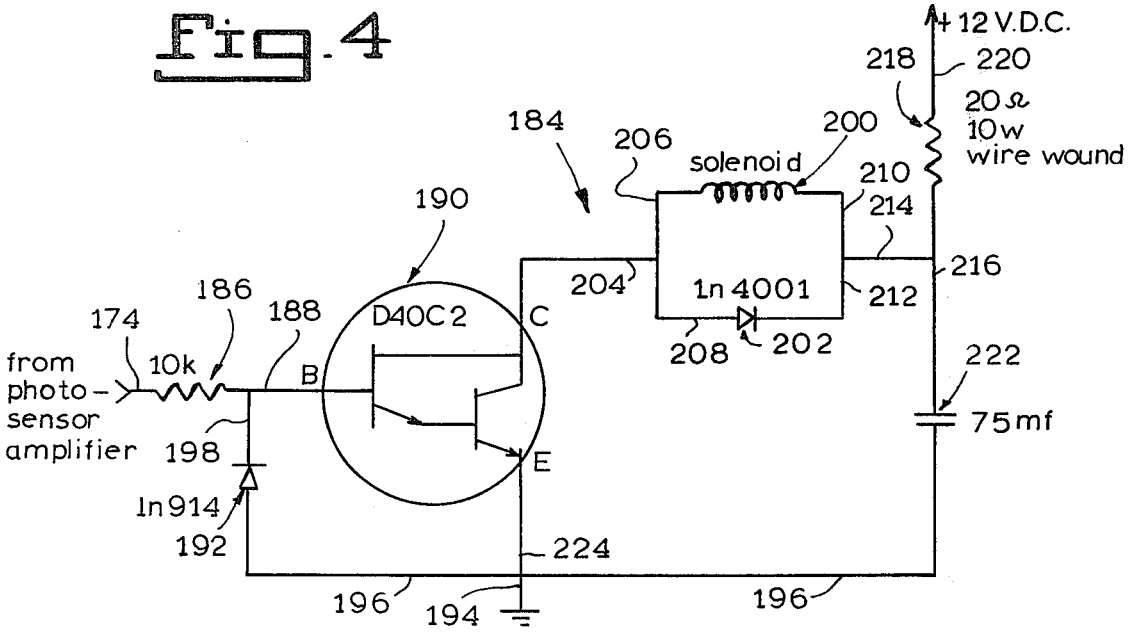
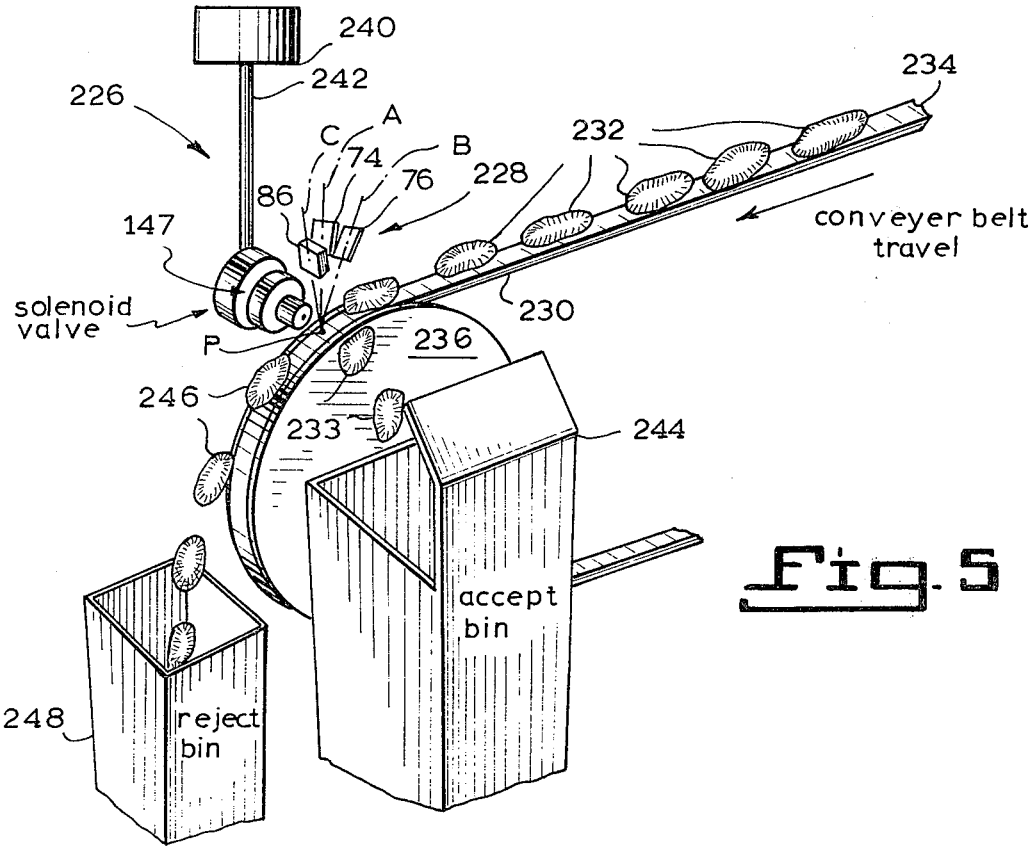
Fig. 5

SORTING APPARATUS

BACKGROUND OF THE INVENTION

The need to sort various types of objects in accordance with size, color and the like has been recognized for many years. This need exists since the size or the color of an object in many instances indicates its value or its suitability for some particular purpose. The need for some type of sorting apparatus has been adequately recognized in such fields associated with agriculture where there was a requirement for sorting out a particular type of product to determine its value or whether or not it was suitable to meet requirements for canning or other purposes.

For instance, when edible seeds such as navy pea beans, great northerns, sesame seeds, sunflower seeds and coffee beans are sent to the consumer, they are ranked by a government insepector as to the uniformness of their quality. Consumer preference is for a product virtually free of discolored, shriveled or split seeds. When the seeds arrive at a grain elevator from the farmers of the surrounding countryside, not only are these "bad" seeds present, but also mudballs, rocks and some other plant material. These latter undesirable materials may be to a large degree removed by a shaker—a sort of large sieve. The output of the shaker is basically all seeds but it contains both good as well as bad seeds. In order to improve their product and so command a higher market price, either the elevator company or packagers have to separate the bad seeds from the good.

It has long been desirable to do this separation by a machine rather than by hand. A machine that would achieve this has to be able to recognize the difference between good and bad seeds, and to separate them into two groups at a speed great enough to handle the large volumes involved, and at a low enough cost to make it worthwhile.

Such a machine was designed and built by Everett H. Bickley (1888–1972) a mechanical engineer who lived in the Philadelphia area. First produced in the early 1930's, the Bickley Bean Sorter worked on a very simple principle. Beans were mechanically fed onto a conveyor belt that carried and aligned them in a single file to a sorting point. There a white light was focused on them, and the light reflected off of them was "read" by a photocell. Good beans reflected enough light to activate the photocell closing an electric circuit that opened an electromagnetic flapper valve. The open valve permitted air under pressure to divert the good beans into an accept bin, while bad beans continued straight into the reject bin.

At present, the Bickley Bean Sorter has an upper limit of about 30 beans per second per sorting point. At this decision speed it makes a good separation. The limiting factor of speed is the air rejection mechanism. The valve itself has a period of about 20 ms or 50 cycles per second. But the latex connector hose and the low pressure used, necessary because of the valve design, combine to decrease the rate at which beans can actually be sorted to the 30 per second level. Indeed, in order to obtain excellent separation, even slower speeds were used. Therefore, it was necessary to have as many as 32 sorting points on a machine and if large quantities of beans were to be sorted, many machines were required. The need for an improvement upon such sorting has also been previously recognized as indicated by U.S. Pat. Nos. 2,730,234 and 3,283,896 which disclose means for sorting beans, rice, coffee beans, peanuts and the like according to their color.

However, there is still a need for an improved sorting apparatus since the sorting apparatus disclosed in these patents and presently in use are inefficient and do not have the desired speed for sorting such articles.

The present invention overcomes the disadvantages present in previous and current article sorting apparatus and provides an article sorting apparatus that is efficient and rapidly sorts numerous types of articles.

BRIEF DESCRIPTION OF THE INVENTION

This invention relates to article sorting apparatus and more particularly to sorting apparatus that utilizes emitted light.

It is an object of the invention to provide sorting apparatus that efficiently sorts various articles.

It is an object of the present invention to provide a sorting apparatus which rapidly sorts various types of objects or articles.

It is an object of the present invention to provide sorting apparatus that can be utilized to sort a wide variety of objects.

It is an object of the present invention to provide sorting apparatus which accurately sorts the objects that are to be sorted.

It is an object of the present invention to provide sorting apparatus that can readily be converted to sort various types of objects.

It is also an object of the present invention to provide sorting apparatus for sorting objects that is easy to maintain.

It is a further object of the present invention to provide sorting apparatus for sorting objects that is inexpensive to produce.

The present invention provides sorting apparatus for sorting objects including apparatus for causing the objects to travel in a predetermined direction or path, apparatus for emitting light within a given frequency range located in position to illuminate at least a portion of each of the objects, reflected light detection apparatus for detecting reflected light from the objects and apparatus responsive to the reflected light detection apparatus for sorting the objects based upon the reflected light.

BRIEF DESCRIPTION OF THE DRAWINGS

The invention will be hereinafter more fully described with reference to the accompanying drawings in which:

FIG. 3 is a circuit diagram of a photosensor and the circuitry to amplify the input signal which forms part of the present invention;

FIG. 4 is a circuit diagram of a solenoid driver which forms part of the present invention; and FIG. 5 is a perspective view of a portion of the sorting apparatus of the present invention illustrating the physical arrangement of the light emitting diodes, photo transistors and the solenoid.

DETAILED DESCRIPTION OF THE PREFERRED EMBODIMENT

Figure 1:
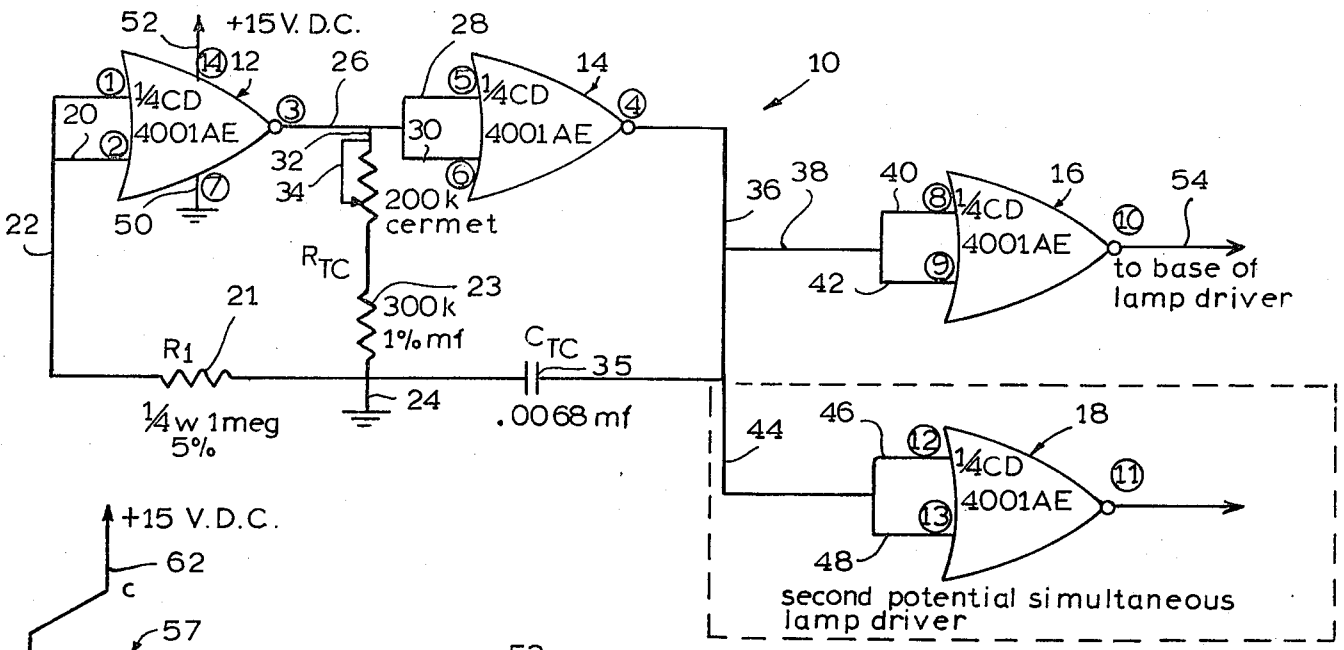
FIG. 1 is a circuit diagram of a square wave generator which forms part of the sorting apparatus of the invention.

In FIG. 1, square wave generator means designated generally by the number 10 that forms part of the invention for sorting objects is illustrated. The square wave generator means includes a square wave generator circuit including three and/or four NOR gates designated by the numbers 12, 14 and 16 and possibly 18 of Control Data digital integrated circuit commonly designated 4001AE and the manner in which the contacts of the integrated circuit are connected. Contacts 1 and 2 are together connected through a 1 Megohm ¼ watt 5% resistor 21 to ground via leads 20, 22 and 24. Contacts 3, 5 and 6 are connected via leads 26, 28, 30 and 32 to both the variable and a fixed input of a 200 kilohm cermet potentiometer 34 in order to provide a means of varying the frequency of the generated square wave. The cermet potentiometer 34 is in turn connected through a 300 kilohm 1% metal film resistor 23 via lead 24 to ground. Contacts 4, 8 and 9 are connected to a 0.0068 microfarad capacitor 35, via leads 36, 38, 40 and 42, which is in turn connected to ground via lead 24. Contact 4 can also be connected to contacts 12 and 13 via leads 44, 46 and 48 in order to provide a second independent but simultaneous square wave output, if it was desirable to have a second LED driver circuit to pulse more LEDs. The output of the square wave generator is contact 10 (and potentially contact 11). Contact 7 via lead 50 is connected to ground, and contact 14 is connected to +15 Volts D.C. via lead 52.

Figure 2:
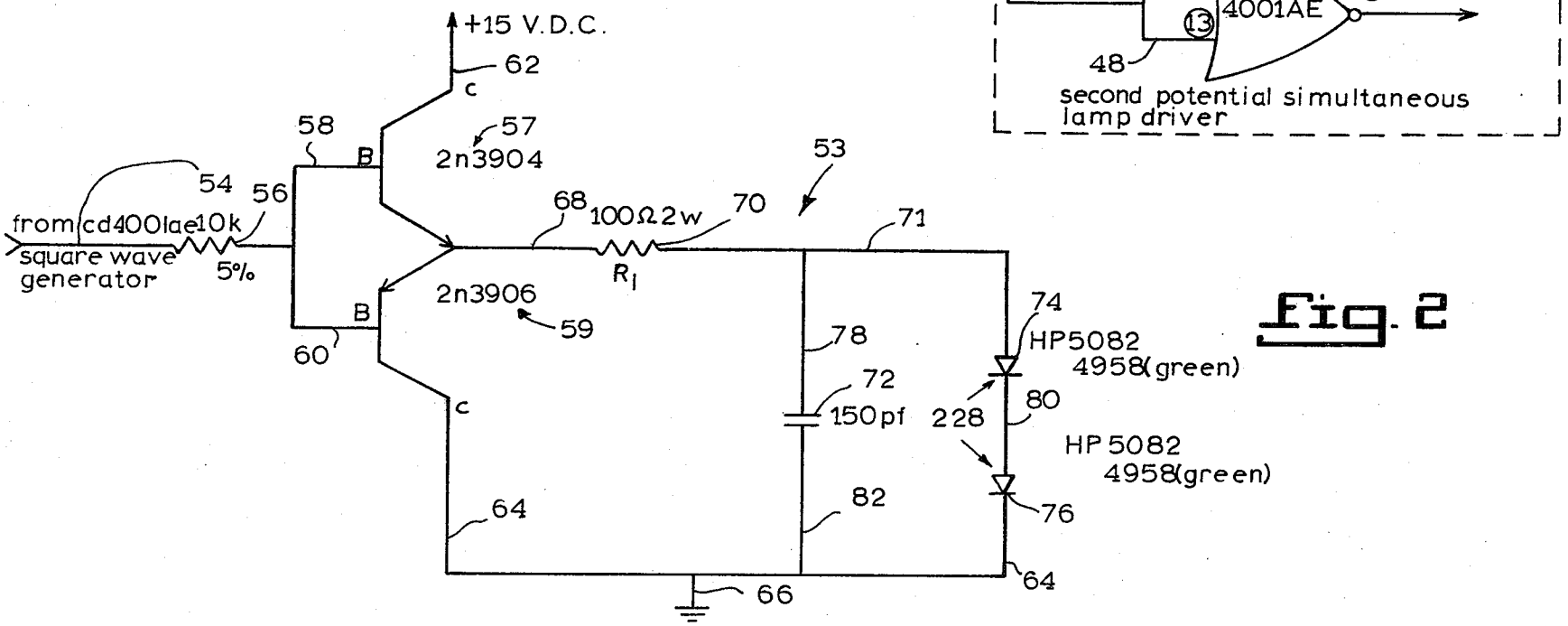
FIG. 2 is a circuit diagram of a light emitting diode driver which forms part of the present invention.
Figure 9:
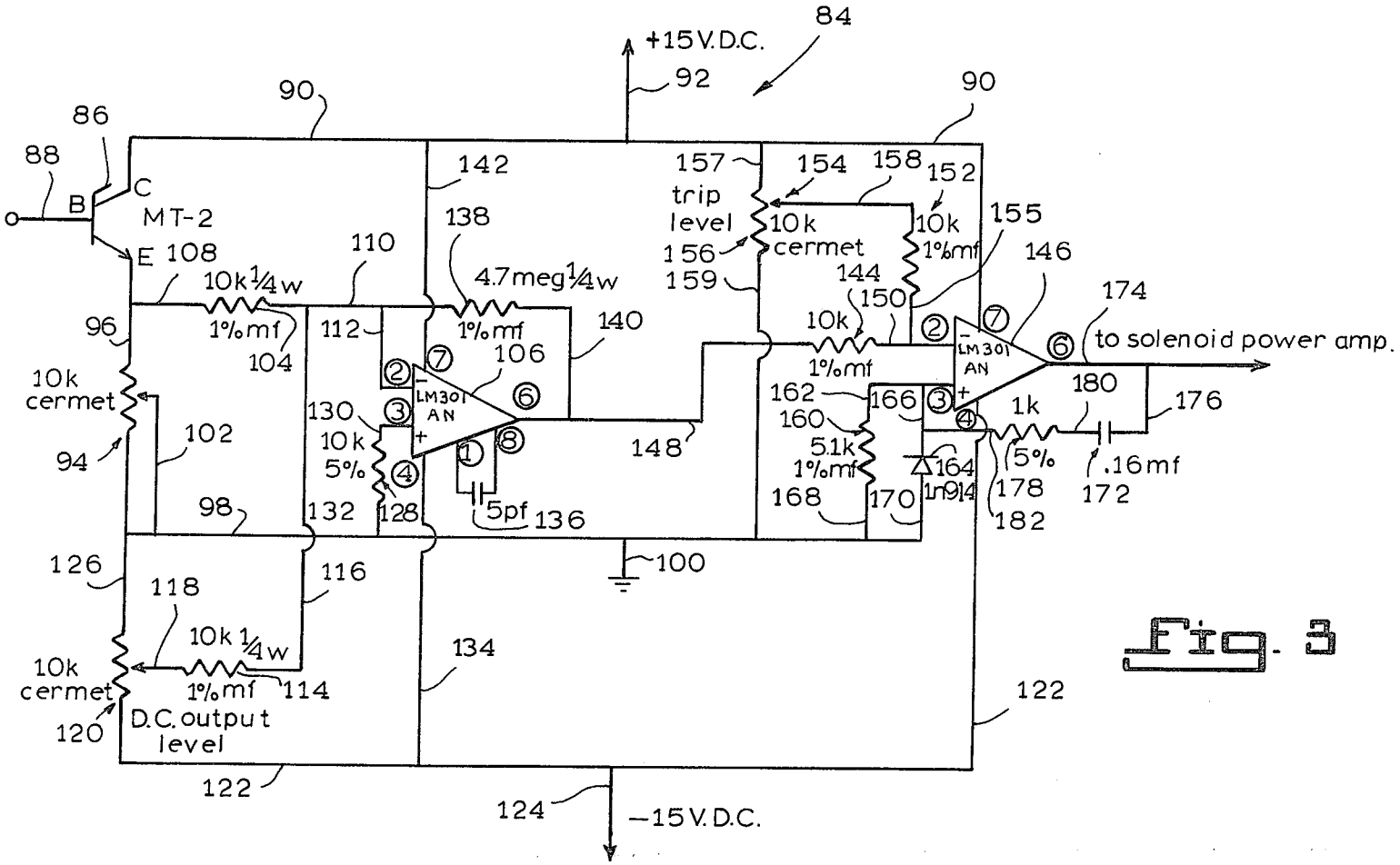

The output of the square wave generator 10 via the lead 54 is the input to the LED driver schematically represented in FIG. 2 which is designated generally by the number 53. The LED driver 53 and the square wave generator 10 comprise means for emitting pulses of light. As indicated with respect to FIG. 1, the frequency of the generated square wave from the generator 10 can be varied. This in conjunction with the LED driver 53 comprises means for emitting light pulses at a sufficient frequency or periodic intervals to insure that each object to be illuminated is subjected to at least one light pulse or if desired a plurality of light pulses. The input via lead 54 is connected through a 10 kilohm 5% resistor 56 to the bases of both a 2N3904 and a 2N3906 transistor, 57 and 59 respectively, via leads 58 and 60. The collector of the 2N3904 transistor is connected to +15 Volts D.C. by lead 62 and the collector of the 2N3906 transistor is connected to ground via the leads 64 and 66. The emitters of the two transistors 57 and 59 are together connected via lead 68 through a variable resistor 70 and then via leads 71 and 78 to both a 150 picafarad capacitor 72 and also via the lead 71 to the LEDs 74 and 76, which are to be driven by and form part of the circuit 53. The capacitor 72 is in turn connected to ground via the leads 82 and 66 and the LEDs are connected to one another in series via the lead 80 and then to ground via the leads 64 and 66. The resistor 70 must be varied depending on the number of LEDs being driven by the circuit 53. The two LEDs 74 and 76 can be from the Hewlett Packard 5082 series and the resistor 70 is a 100 ohm 2 watt resistor. The LEDs 74 and 76 are replacable by other types and may be varied in number and color in order to produce the greatest differentiation in color of the product being sorted in accordance with the laws of light reflection and absorption on opaque surfaces which are well known in the art. Consequently, the LEDs 74 and 76 comprise means for varying the given light frequency range of the light pulses. A typical combination of LEDs for the sorting of agricultural products such as coffee beans are two Hewlett Packard 5082-4958 (green) LEDs 76 and 74.

FIG. 3 represents the phototransistor and the circuit needed to amplify the signal of light which it receives that is designated generally by the number 84 and which comprises reflected light detecting means for detecting pulses of light. The phototransistor and the associated circuit comprise means for detecting reflected light pulses from illuminated objects at a sufficient time frequency or periodic intervals to insure that reflected light is detected from each object. The light is received by a silicon phototransistor 86 which can specifically be a Monsanto MT2 in the preferred embodiment. The base 88 of the phototransistor 86 is unconnected. The collector is connected to +15 Volts D.C. via the leads 90 and 92. The emitter is connected through a 10 kilohm cermet potentiometer 94 to ground via the respective leads 96, 98 and 100. The variable input 102 of the potentiometer 94 is also connected to ground via the leads 98 and 100. The emitter of the phototransistor 86 is also connected through a 10 kilohm ¼ watt 1% metal film resistor 104 to contact 2 of an LM301AN operational amplifier (op amp I) via the respective leads 96, 108, 110 and 112. Op amp I is designed to amplify the signal of MT2 about 500 times. Contact 2 of op amp I 106 is also connected through a 10 kilohm ¼ watt 1% metal film resistor 114 via the respective leads 112, 110 and 116 to the variable input 118 of a 10 kilohm cermet potentiometer 120 whose fixed leads are connected to −15 Volts D.C. and ground respectively via the respective leads 122, 124, 126, 98 and 100. This acts as a D.C. level for the input to op amp I. The variable input 118 comprises means for varying the responsiveness of the reflected light detecting means 84 to varying intensities of light reflected from objects or articles. This light will be in a given frequency range in most cases.

Contact 3 of op amp I 106 is connected through a 10 kilohm 5% resistor 128 to ground via the respective leads 130, 132, 98 and 100. Contact 4 of op amp I 106 is connected to −15 Volts D.C. via the leads 124, 122 and 134. Contact 8 of op amp I 106 is connected through a 5 picafarad capacitor 136 to contact 1. Contact 6 of op amp I 106 is connected through a 4.7 megaohm ¼ watt 1% metal film resistor 138 to contact 2 via the leads 140, 110 and 112. Contact 7 is connected to +15 Volts D.C. via the leads 142, 90 and 92. Contact 6 of op amp I 106 is connected through a 10 kilohm 1% metal film resistor 144 to contact 2 of a second LM301AN operational amplifier (op amp II) 146 via the respective leads 148 and 150.

Op amp II 146 is designed to regulate the period of operation of a solenoid air valve 147 that is illustrated in FIG. 5. Contact 2 of op amp II 146 is connected through a 10 kilohm 1% metal film resistor 152 to the variable input 154 of a 10 kilohm cermet potentiometer 156 via the respective leads 155 and 158. The potentiometer's fixed leads are connected to +15 Volts D.C. and ground respectively via the respective leads 157, 90, 92, 159, 98 and 100. This sets the trip level of op amp II 146. Contact 3 of op amp II 146 is connected to a 5.1 kilohm 1% metal film resistor 160 via the lead 162 and to a 1N914 diode 164 via the leads 162 and 166. The metal film resistor 160 and the diode 164 are in turn connected to ground via the respective leads 168 and 170 and the leads 98 and 100. Contact 6 of op amp II 146 is connected to a 0.16 microfarad capacitor 172 via the leads 174 and 176. The capacitor 172 is in turn connected to a 1 kilohm 5% resistor 178 via the lead 180 which is in turn connected to the 1N914 diode 164 via leads 182 and 166. Contact 7 of op amp II 146 is connected to +15 Volts D.C. via the leads 90 and 92. Contact 4 is connected via leads 122 and 124 to −15 Volts D.C. The capacitor 172 of op amp II 146 may be varied in order to vary the period the solenoid valve 147 is open to suit various sorting speed requirements.

Contact 6, via lead 174, provides the input current for the power amplification of the solenoid driver diagrammed in FIG. 4 and designated generally by the number 184. The input signal is connected through a 10 kilohm resistor 186 via the lead 188 to the base of a D40C2 transistor 190 which functions as a Darlington Amplifier. A 1N914 diode 192 is connected from ground to the base of the D40C2 transistor 190 via the respective leads 194, 196, 198 and 188. The collector of the D40C2 transistor 190 is connected to a parallel combination of the solenoid 200 and a 1N4001 diode 202 via the common lead 204 and then the respective leads 206 and 208. The solenoid used is that found in a fuel injector in current Volkswagon engines, and it is manufactured by Robert Bosch Corp., a West German company. This injector is given the number 147 in FIG. 5. The solenoid 200 and diode 202 are in turn connected via the respective leads 210 and 212 and via the common leads 214 and 216 to two components, a 20 ohm 10 watt wire wound resistor 218 that is in turn connected to +12 Volts D.C. via lead 220 and a 75 microfarad capacitor 222 that is in turn connected to ground via the leads 196 and 194. The emitter of the D40C2 transistor 190 is connected to ground via the leads 224 and 194.

FIG. 5 illustrates the physical arrangement of the sorting point apparatus or equipment that is designated generally by the number 226. The means for emitting light within a given frequency range comprises a light emitting assembly 228 which comprises the light emitting diodes (LEDs), 74 and 76 are positioned over a conveyor belt 230 apparatus to provide light such as light pulses to illuminate the articles 232, or at least a portion of such articles, on the conveyor belt system 234 that are to be sorted as the objects 232 travel in a predetermined path or direction which is determined by the conveyor belt apparatus. These articles or objects can comprise seeds or other agricultural products, etc. The solenoid air valve 147 is at one side of the belt in order to release a burst or pulse of a fluid such as a gas or gasses such as air across the belt system 234 substantially parallel to the axis around which the pulley 236 associated with the conveyor belt system 234 turns which both comprise means for causing objects to travel in a predetermined direction or path. Means for detecting at least a portion of the reflected light resulting from the illumination of at least a portion of each of the objects or articles 232 comprising reflected light receiving means 86 for receiving reflected light from the objects 232 that are to be subjected to light for sorting purposes from the light emitting assembly 228 is operationally associated with the light emitting assembly 228. Conduit means such as a tube 242 is connected to means responsive to the reflected light detection means for sorting the objects 232 based upon the reflected light comprising the valve means 147 and the tube 242 is also connected to a pressurized source of fluid 240.

An accept bin 244 is located on the opposite side of the conveyor belt system 234 from the solenoid valve 147 which are so located that a blast or pulse of fluid from the valve 147 will result in fluid pressure being exerted on at least some of the objects 232 to cause certain desired sorting objects 233 to be forced into an accept bin or recepticle 244. Those objects 246 that are not acceptable fall by gravity into a bin or recepticle 248.

In order to utilize the invention, electric power is supplied to the circuits illustrated in FIGS. 1 through 4 in a conventional manner. Electric power is also supplied to cause the conveyor belt system 234 to move in the direction illustrated in FIG. 5 and articles 232 to be sorted are supplied to the conveyor belt 234 in a conventional manner that is well known in the art.

The square wave generator 10 set forth in FIG. 1 provides pulses substantially in the form of a square wave via the lead 54 to the light emitting diode driver 53 set forth in FIG. 2 which causes the diodes 74 and 76 of the light emitting assembly 228 to emit pulses of light that illuminate the articles 232 to be sorted and this results in reflected light pulses from the objects or articles 232 to be sorted.

The physical arrangement or location of the diodes 74 and 76 of the assembly 228 and the phototransistor 86 are illustrated in FIG. 5. As illustrated in FIG. 5 the diodes 74 and 76 and the phototransistor 86 are located above the conveyor belt system 234 at a location above the conveyor belt assembly which is the sorting point designated by the letter P. The diodes 74 and 76 and the phototransistor 86 are arranged in a generally triangular configuration with the diodes 74 and 76 being located generally beside each other and to the rear of the phototransistor 86 when considering the direction of travel of the upper conveyor belt system 234 as being forward. The diodes 74 and 76 and the phototransistor 86 generally have their respective optical axes, designated respectively by the letters A, B, and C, converging on the sorting point P. However, the diodes 74 and 76 and the phototransistor 86 need not be focused on the objects 232 since the diodes 74 and 76 illuminate a large size area. Consequently, the diodes 74 and 76 and the phototransistor 86 are responsive to objects 232 of various sizes and at different positions on the belt system 234.

At least some portion of some of these reflected light pulses from the articles 232 to be sorted impinge upon the phototransistor 86 of the circuit 84 set forth in FIG. 3. If the portion of some of these reflected light pulses indicate that a desired article 233 is present at a selected point P on the conveyor belt system 234 a proper signal is sent from the circuit 84 via the lead 174 to the solenoid driver circuit set forth in FIG. 4. This causes the solenoid 200 that forms part of the solenoid valve 147 in FIG. 5 to be activated and this permits pressurized fluid to pass from the pressurized fluid source 240 through the conduit 242 through the solenoid valve 147 so that a pulse or stream of fluid impinges upon a desired article 233 to cause it to fall or pass into the accept bin 244.

The undesired articles 245 have no such fluid stream or pulse that impinges upon them and hence as illustrated in FIG. 5, they come off the conveyor belt 234 and into the reject bin 248. It, of course, will be appreciated that FIG. 5 illustrates only one sorting point or operation whereas many of such points could be put into use for one or more of a given type of articles 232. It should be noted that frequency of the fluid pulses from the solenoid valve and/or the light pulses from the light emitting diodes 74 and 76 of the light emitting assembly 228 can be varied. In addition, the light frequency can be changed by changing or substituting one or more of diodes 74 and/or 76 in FIG. 2 to one that emits light of a different frequency. It will be appreciated that certain equipment, for example holding means such as brackets, etc. that are well known in the art have been omitted from FIG. 5 for clarity.

The circuits illustrated in FIGS. 1 through 4 are merely representative and obviously variations can be made from the preferred embodiment illustrated in these figures. In this connection, the term "lead" can mean a portion of a printed circuit or any other type of electron conductor.

Although the invention has been described in considerable detail with reference to a certain preferred embodiment, it will be understood that variations or modifications may be made within the spirit and scope of the invention as defined in the appended claims.

What is claimed is:

1. Sorting apparatus for sorting objects comprising means for causing said objects to travel in a predetermined direction or path, light emitting means for emitting light pulses at a sufficient frequency or periodic time intervals that each object is subjected to at least one light pulse, said light emitting means comprising a squarewave generator, a light emitting diode driver and associated light emitting diodes connected to said squarewave generator and means for varying the frequency of the generated square wave of said squarewave generator, said light emitting diodes being located in position to illuminate at least a portion of each of said objects as said objects travel in said predetermined direction or path, reflected light detecting means for detecting at least a portion of the reflected light pulses resulting from the illumination of at least a portion of each of said objects at a sufficient time frequency or periodic intervals to insure that reflected light is detected from each object, said reflected light detecting means including a phototransistor and associated signal amplifying circuit and means for varying the responsiveness of said reflected light detecting means to varying intensities of the reflected light in a given light frequency range, and means responsive to said reflected light detection means for sorting said objects based upon said reflected light.

2. The sorting apparatus of claim 1 wherein said means for sorting said objects comprises a valve for exerting fluid pressure on at least some of said objects to be sorted.

3. The sorting apparatus of claim 2 further comprising means for varying the period said valve is open.

4. The sorting apparatus of claim 3 wherein said valve comprises a fuel injector solenoid type valve.

* * * * *